US009554648B2

(12) United States Patent
Hernandez Zaragoza

(10) Patent No.: US 9,554,648 B2
(45) Date of Patent: Jan. 31, 2017

(54) SLIDING SYSTEM FOR DRAWER

(71) Applicant: MABE, S.A. DE C.V., Sanitago de Queretaro (MX)

(72) Inventor: Carlos Hernandez Zaragoza, Sanitago de Queretaro (MX)

(73) Assignee: MABE, S.A. DE C.V., Queretaro (MX)

( * ) Notice: Subject to any disclaimer, the term of this patent is extended or adjusted under 35 U.S.C. 154(b) by 0 days.

(21) Appl. No.: 14/973,053

(22) Filed: Dec. 17, 2015

(65) Prior Publication Data

US 2016/0206092 A1 Jul. 21, 2016

(30) Foreign Application Priority Data

Dec. 17, 2014 (MX) ..... MX/A/2014/015748

(51) Int. Cl.
*A47B 88/04* (2006.01)
*F24C 15/16* (2006.01)

(52) U.S. Cl.
CPC ..... *A47B 88/0455* (2013.01); *F24C 15/16* (2013.01); *A47B 88/0407* (2013.01); *A47B 2088/0459* (2013.01); *A47B 2210/0024* (2013.01); *A47B 2210/04* (2013.01); *A47B 2210/17* (2013.01)

(58) Field of Classification Search
CPC ..... A47B 88/0455; A47B 2088/0459; A47B 88/12; A47B 88/14; A47B 2210/0024; A47B 2210/04; A47B 2210/17
See application file for complete search history.

(56) References Cited

U.S. PATENT DOCUMENTS

| | | | | |
|---|---|---|---|---|
| 735,716 | A | 8/1903 | Dahlquist | |
| 5,111,940 | A | 5/1992 | VanNoord | |
| 7,087,862 | B1 * | 8/2006 | Shaffer | F24C 15/168 126/333 |
| 8,577,254 | B2 | 11/2013 | Katogi | |
| 2005/0174022 | A1 | 8/2005 | Kuttalek | |
| 2007/0018548 | A1 * | 1/2007 | Ertz | A47B 88/02 312/402 |
| 2009/0243450 | A1 | 10/2009 | Weng | |
| 2014/0001943 | A1 * | 1/2014 | Kim | F25D 25/022 312/404 |
| 2014/0291266 | A1 * | 10/2014 | Yang | A47B 96/00 211/126.15 |

(Continued)

FOREIGN PATENT DOCUMENTS

| | | |
|---|---|---|
| CN | 103216991 | 7/2013 |
| DE | 19817499 | 9/1999 |

(Continued)

*Primary Examiner* — Daniel Rohrhoff
(74) *Attorney, Agent, or Firm* — Terry M. Sanks, Esq.; Beusse Wolter Sanks & Maire, PLLC

(57) ABSTRACT

The present invention relates to a sliding system for a drawer comprising a main base which is fixed unto a grill whose front end of the base overlaps from the same; a wire rod base set over the main base by means of a fixed rail, said wire rod base allows for the complete aperture of the drawer; a drawer base which supports the drawers and remains fixed unto the system; a plurality of bushings which decrease the amount of friction, which allows for smooth and silent sliding; a magnet which provides closing force to the drawer which grants the closing sensation when the drawer reaches the bump and extractable drawers which are transportable.

14 Claims, 11 Drawing Sheets

(56) References Cited

U.S. PATENT DOCUMENTS

| | | | | |
|---|---|---|---|---|
| 2015/0208801 | A1* | 7/2015 | Hu | A47B 88/0085<br>312/334.27 |
| 2015/0216303 | A1* | 8/2015 | Rehage | F16C 29/046<br>312/334.17 |

FOREIGN PATENT DOCUMENTS

| | | |
|---|---|---|
| DE | 102011087785 | 6/2013 |
| KR | 20090128905 | 12/2009 |

* cited by examiner

SECCION A-A

SLIDING SYSTEM FOR DRAWER

FIELD OF THE INVENTION

The present invention relates to a sliding system for drawers which allow a drawer to be slid providing a sensation of firmness and continuous sliding to the user, as well as a complete extraction of the drawer, allowing for complete extraction or access of the drawer to the articles thereby found placed at the bottom of said drawer.

The present invention specifically relates to drawers with the above mentioned features for household appliances.

BACKGROUND

Several documents related to sliding systems for a drawer are known in the state of the art, the following mentioned documents correspond to the closest state of the art for the present invention:

Document CN103216991 refers to a stratified frame structure with guiding rails and a drawer device. The stratified frame structure with guiding rails comprises a stratified frame body, wherein the sliding grooves are formed in two sides of an upper surface of the stratified frame structure respectively and the stratified frame structure and the sliding grooves form part of the integral structure. The drawer device comprises a drawer and at least one stratified frame structure with the rail guides, in which the rail guides of the drawer are set on both sides of the drawer, and the drawer is mounted on the rail guide by means of sliding grooves through the rail guides of the drawer. Said invention is adequate for use of mountable drawers, such as for use in a refrigerator, a wine rack, a drink drawer and a freezer.

Document DE 19817499 refers to an oven with a telescopic tray which can be pulled from the area of the lateral wall towards an outer position. It presents horizontal guiding rails in the lateral wall area towards the inner part of the oven, where a retrieving frame is adjusted by means of guiding tubes.

Document DE 102011087785 refers to a device with a compartment which is floor level with a tray surface set towards above for cold goods set in the inner part of a container. A guide is set at floor level, a displaceable drawer mounted unto said guide. The guide is extended over the surface of the tray in such a way that the drawer is set over the surface of the tray.

Document KR 20090128905 refers to a support device for a drawer of a refrigerator comprising a drawer, a cover, a part, which supports the cover. A receptor part for storing food is formed within the drawer, the drawer being moveable within the refrigerator, the cover covering the drawer.

Document U.S. Pat. No. 735,716 refers to a shelf combination, a pair of bars which are secured transversally to said shelf, two pairs of telescopic bars which are supported in a slideable manner over said fixed bars and bars which are crossed and which connect the ends of the upper pair of said slideable bars.

Similarly, the following documents are also known in the state of the art U.S. Pat. No. 5,111,940, U.S. Pat. No. 7,087,862B1, U.S. Pat. No. 8,577,254B2, US2005/0174022A1, US2009/0243450A1 y US20140001943A1.

BRIEF DESCRIPTION OF THE INVENTION

The present invention relates to a sliding system for a drawer which comprises a main base which is fixed unto a grill, a wire rod base set over the main base, said wire rod base comprising a first and second frame, the first frame allows for the complete aperture of the drawer over which the second frame will slide; a drawer base which supports the drawers and remains fixed unto the system through the second frame; a plurality of bushings which decrease the amount of friction; a magnet which provides a closing force to the drawer: and extractable drawers which are transportable.

BRIEF DESCRIPTION OF THE FIGURES

The illustrative embodiment may be described in reference to the accompanying figures, which refer to.

DETAILED DESCRIPTION OF THE INVENTION

Figure 1:
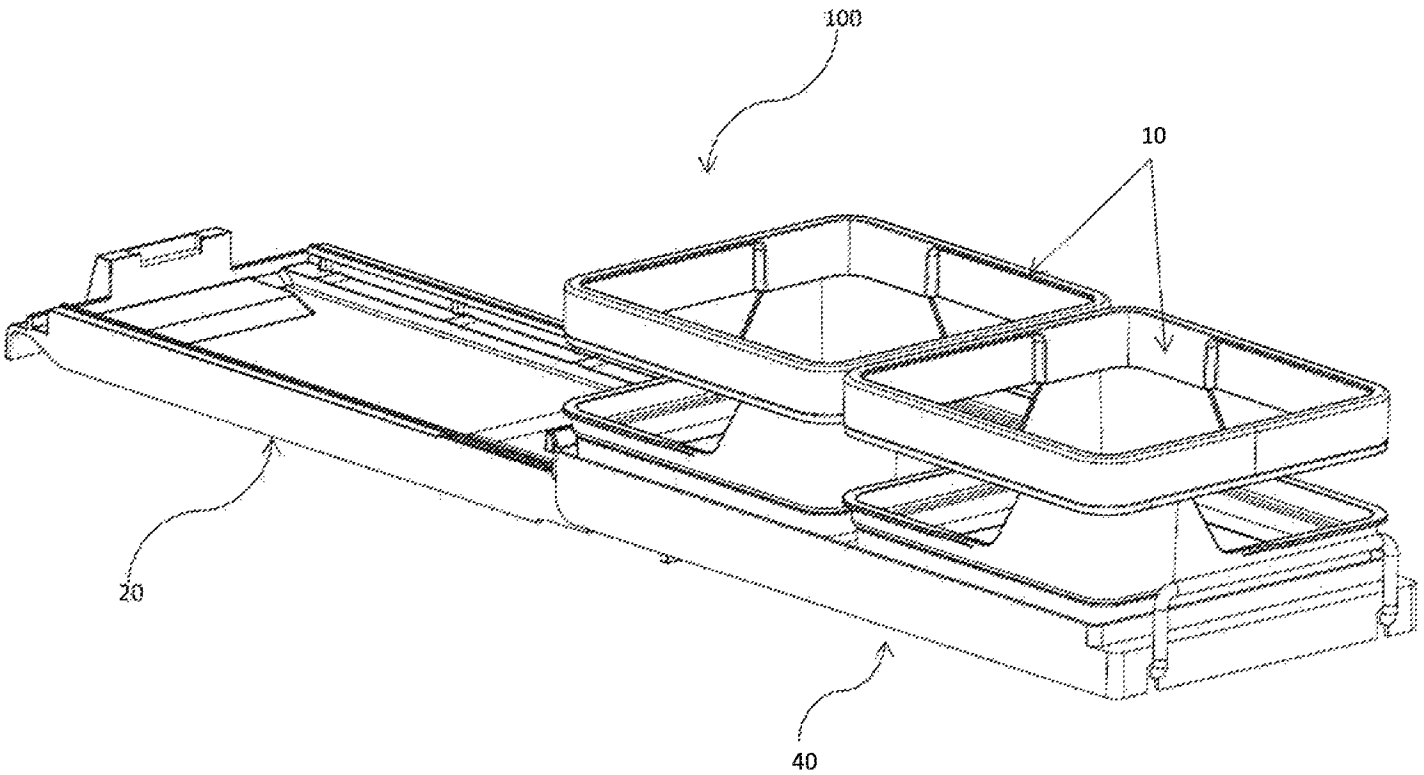
In FIG. 1 a perspective view of the sliding system for drawer of the present invention can be seen.
Figure 2:
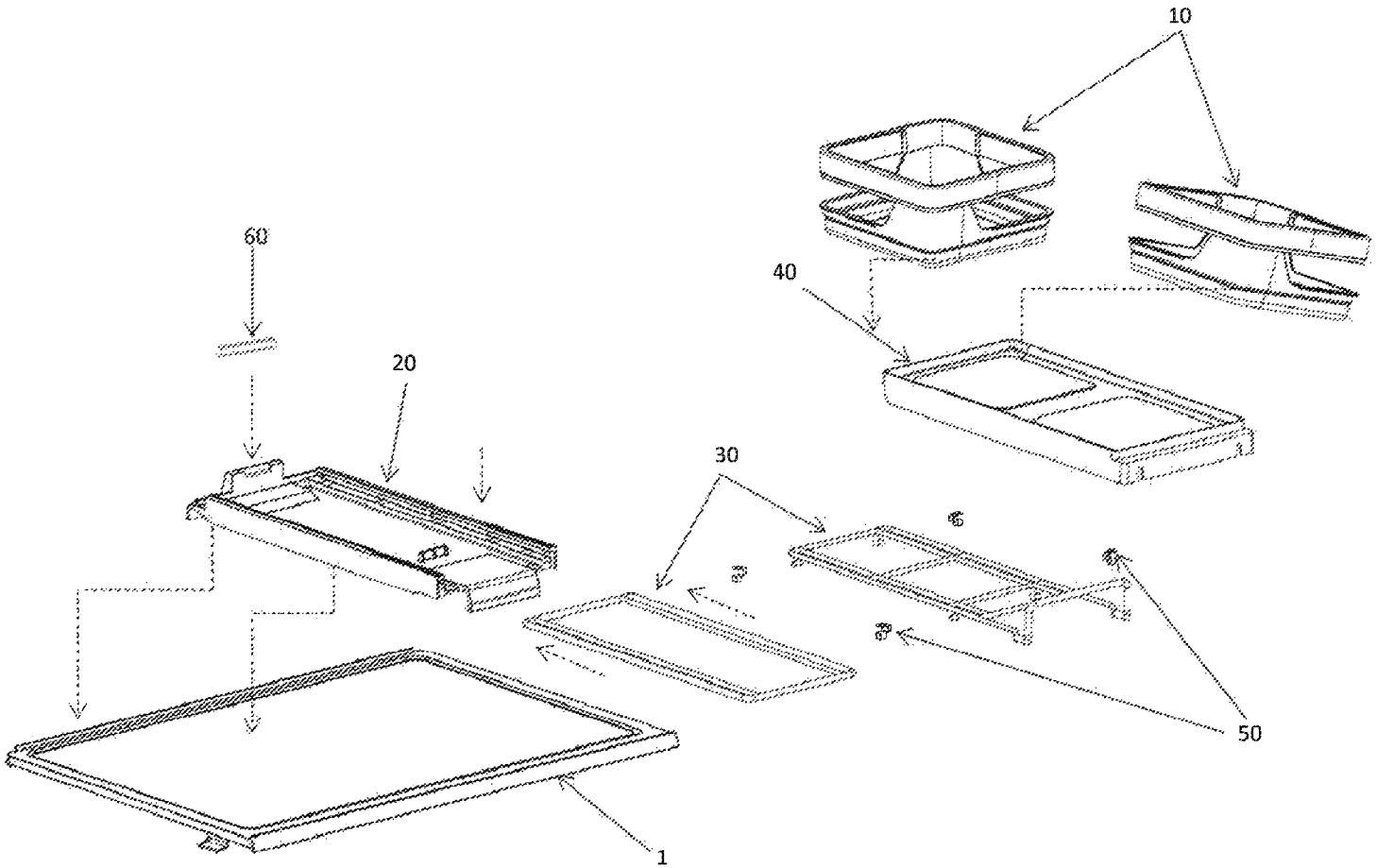
In FIG. 2 an exploded view of the elements which make up the sliding system for drawer of the present invention can be seen.
Figure 3B:
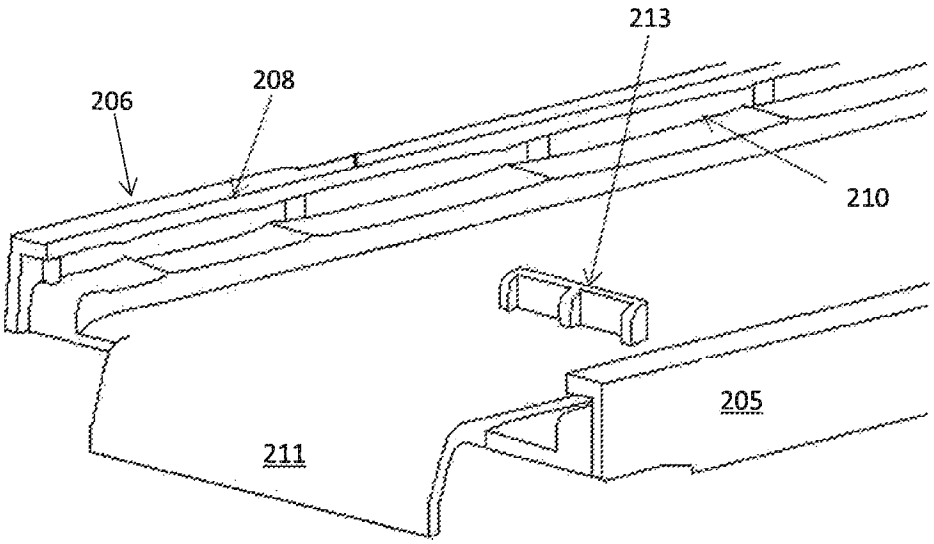
In FIG. 3*b* the front end of the main base of the sliding system for drawer which is joined to the grill which supports it can be seen in detail.
Figure 3A:
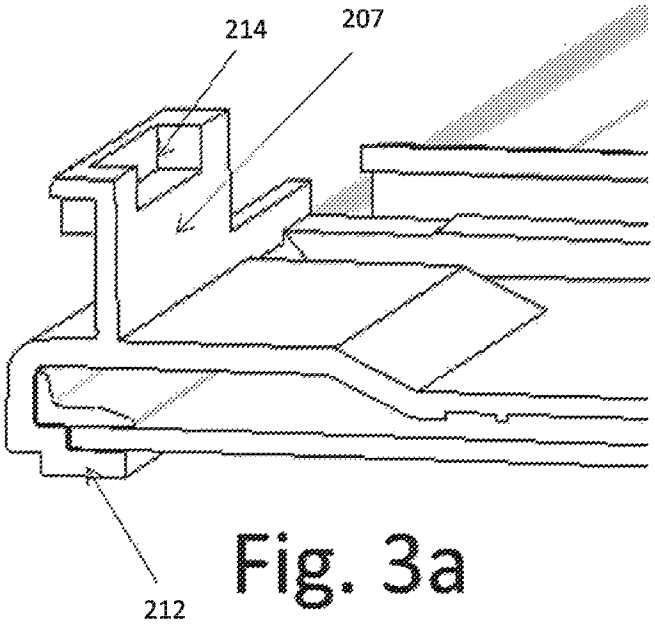
In FIG. 3*a* the back end of the main base of the sliding system for drawer which is joined to the grill which supports it can be seen in detail.
Figure 3C:
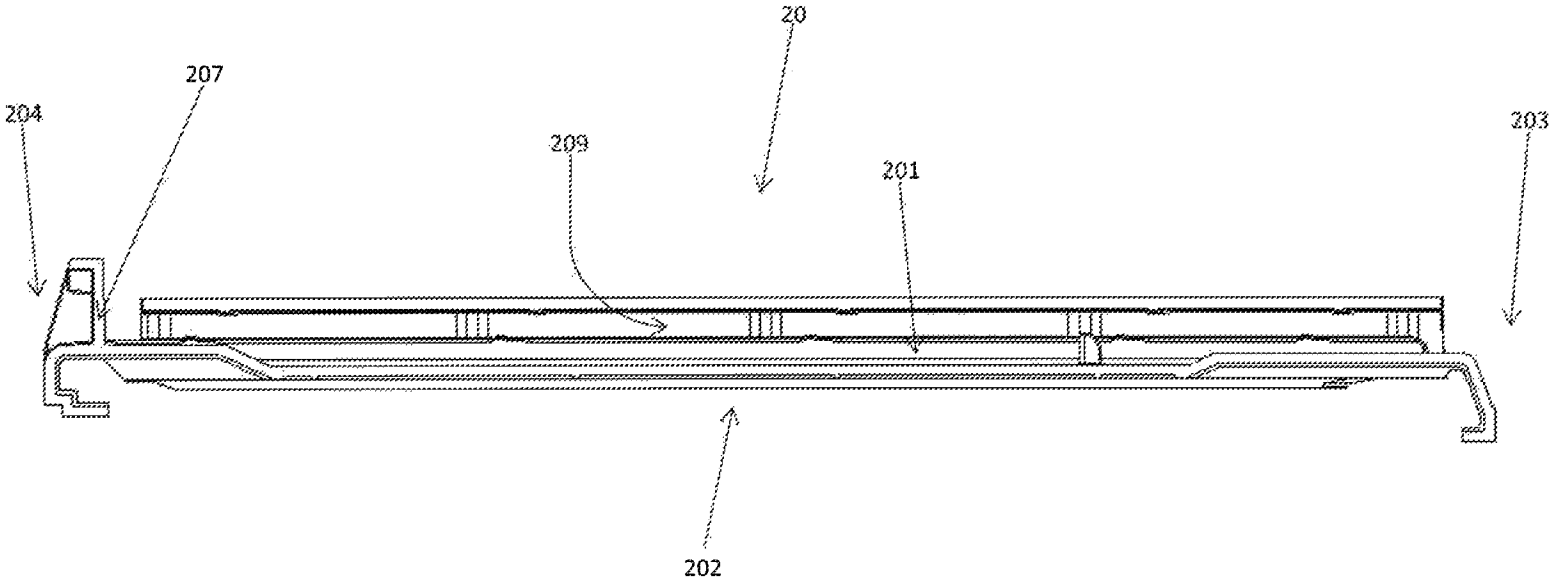
In FIG. 3*c* a longitudinal cut of the main base of the sliding system for drawer can be seen.
Figure 4:
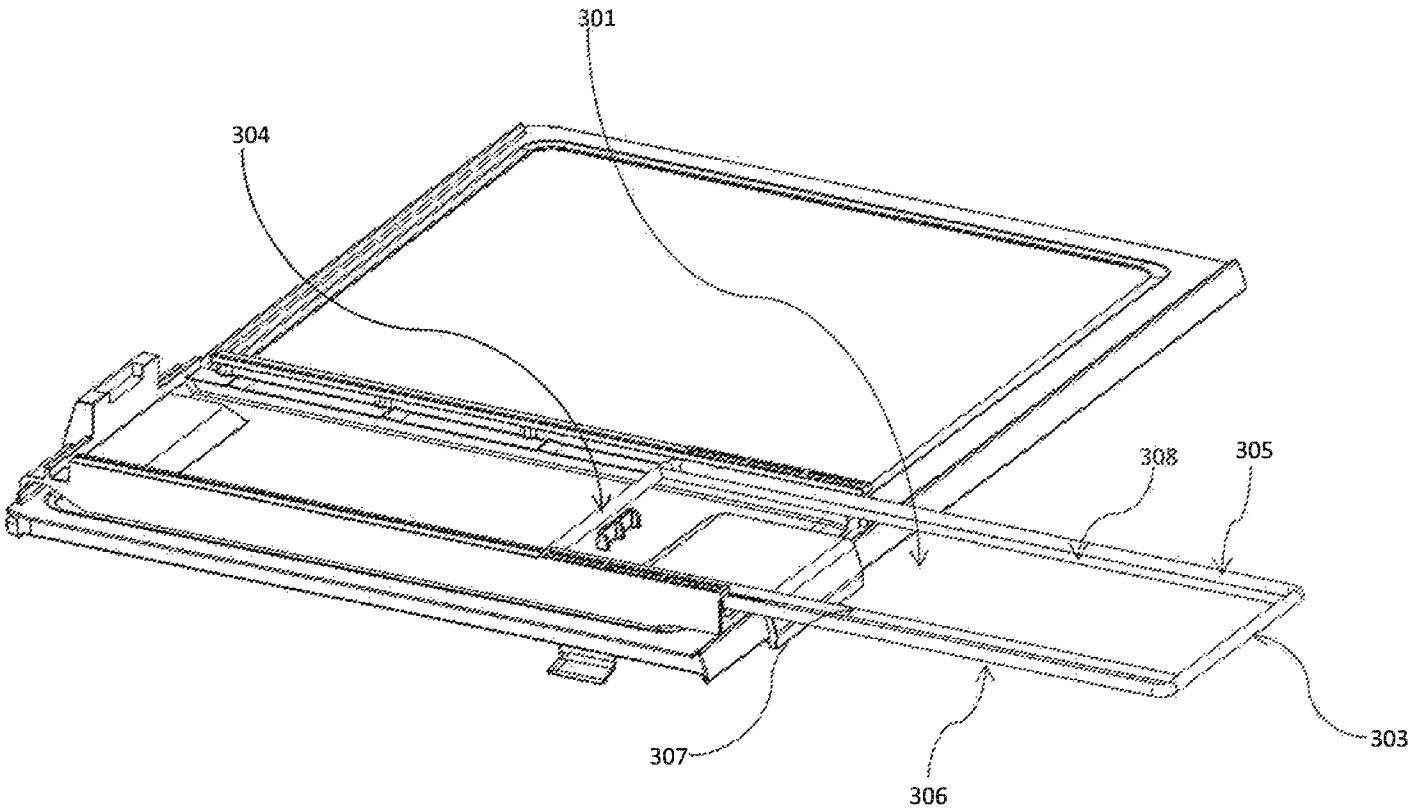
In FIG. 4 the first frame of the wire rod base of the sliding system for drawer can be seen in detail.
Figure 5:
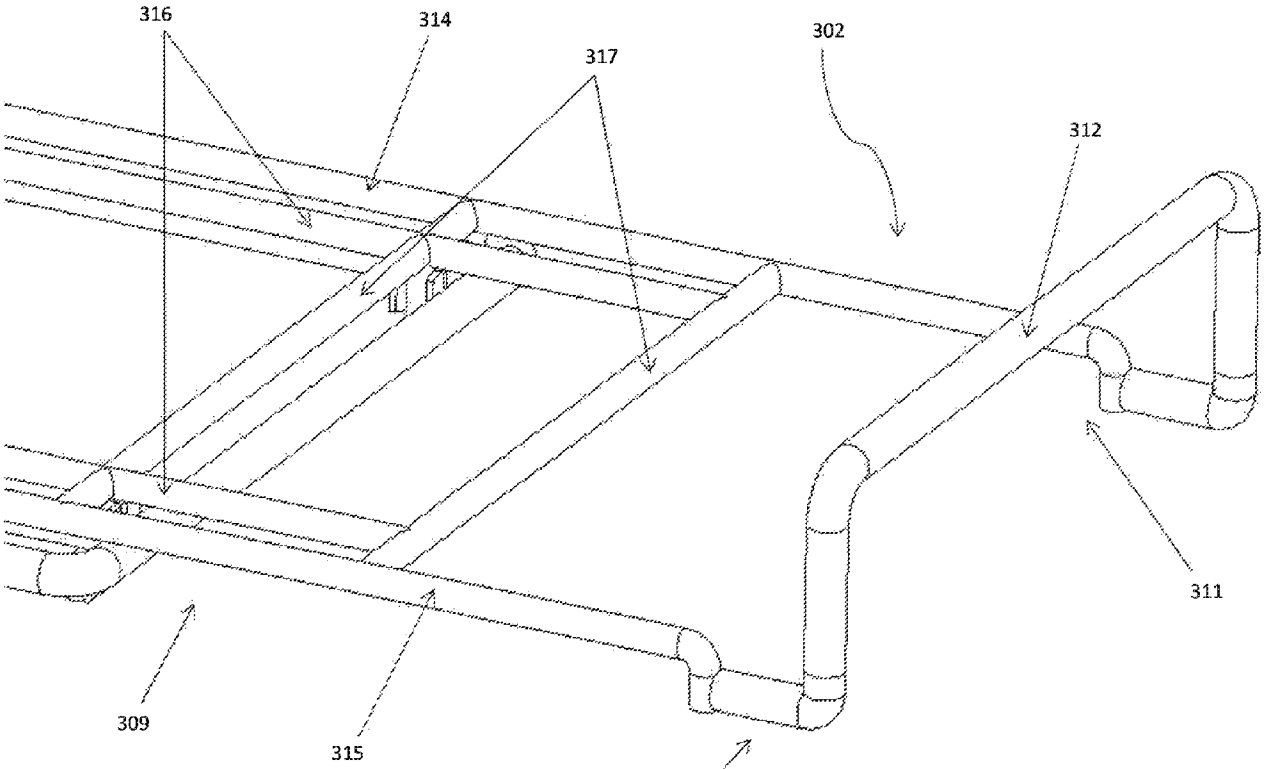
In FIGS. 5 and 6 the second frame of the wire rod base of the sliding system for drawer can be seen in detail.
Figure 6:
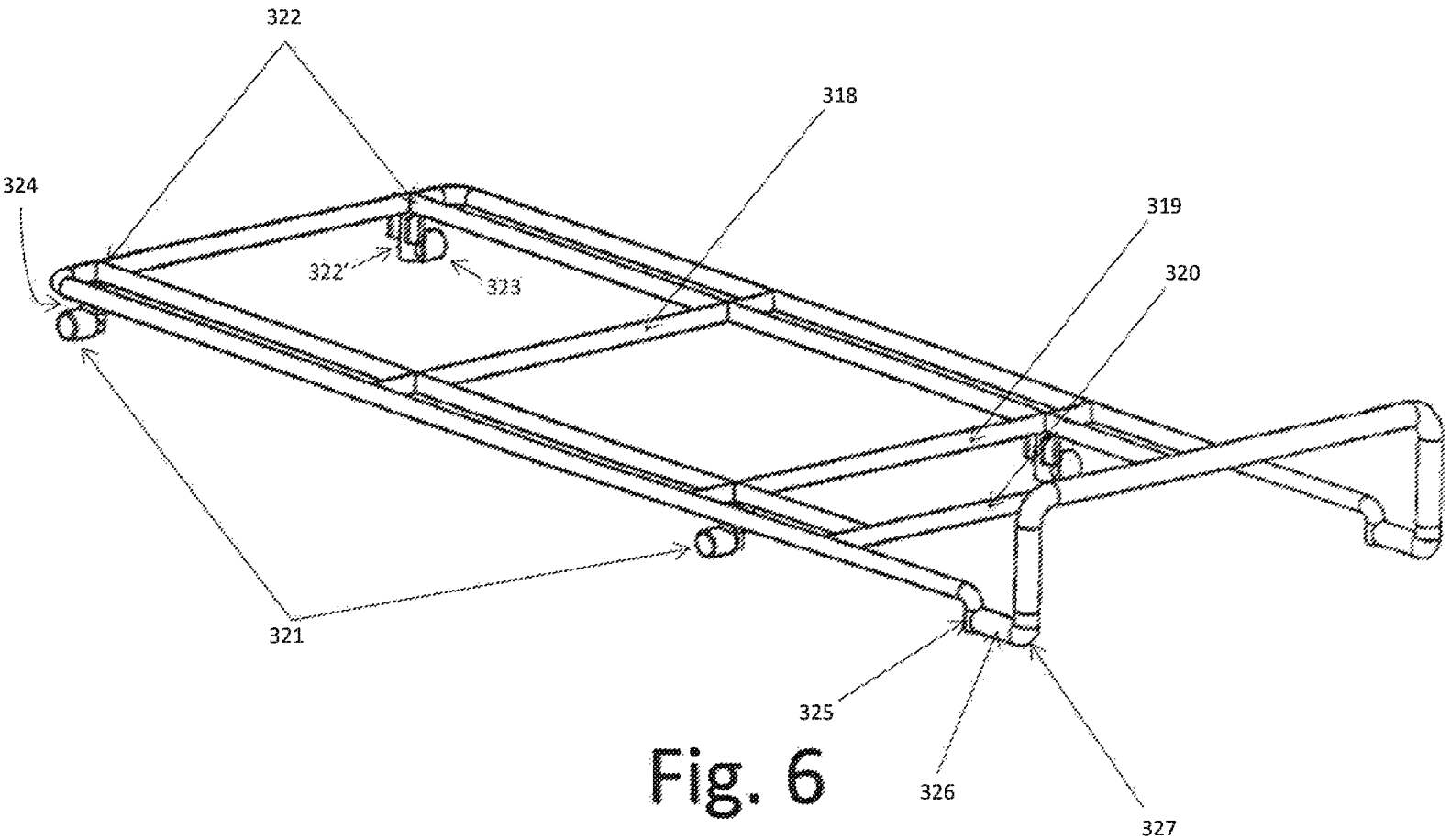
Figure 7A:
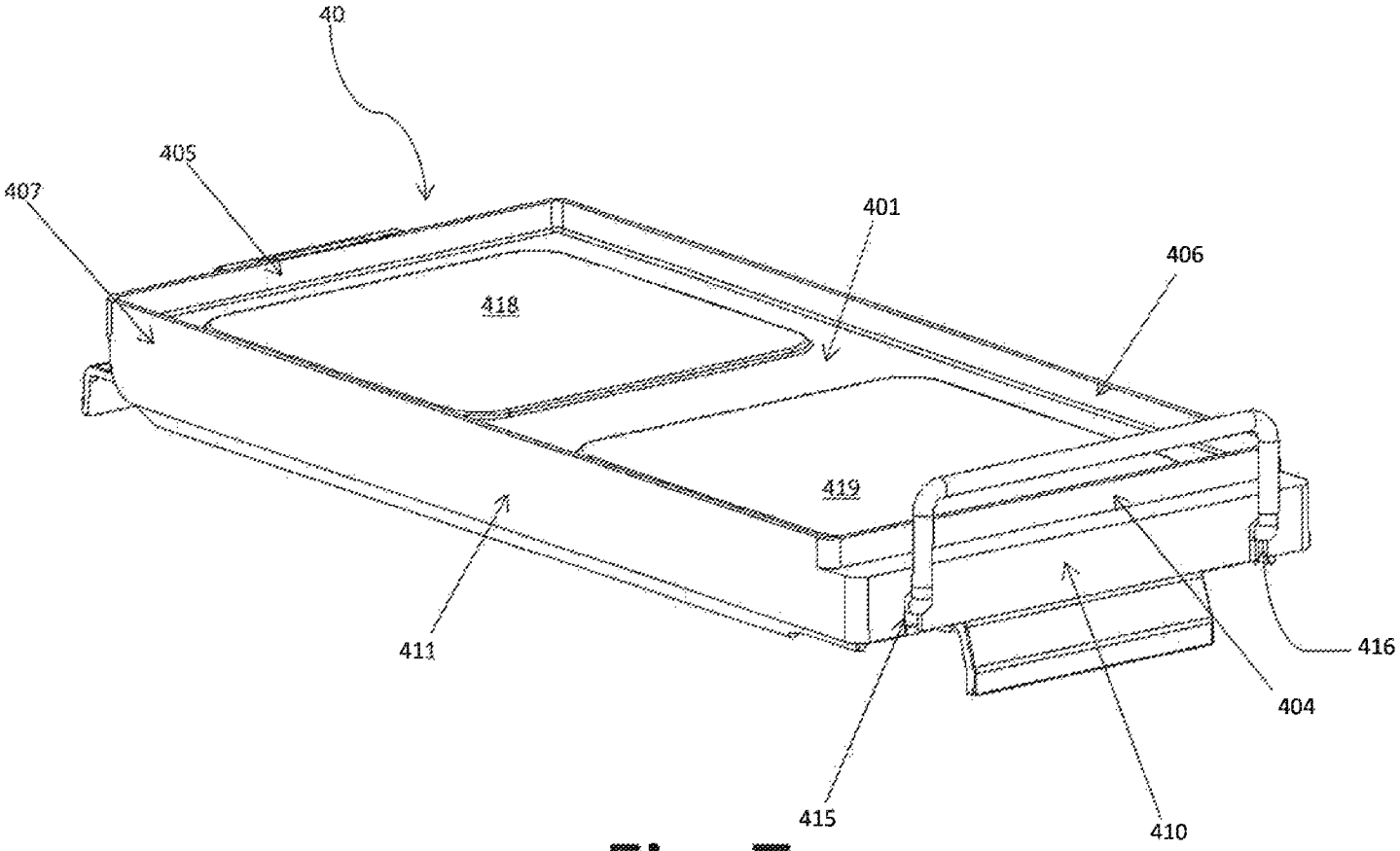
In FIG. 7*a* a perspective view of the base of the drawer of the sliding system for drawer can be seen.
Figure 7C:
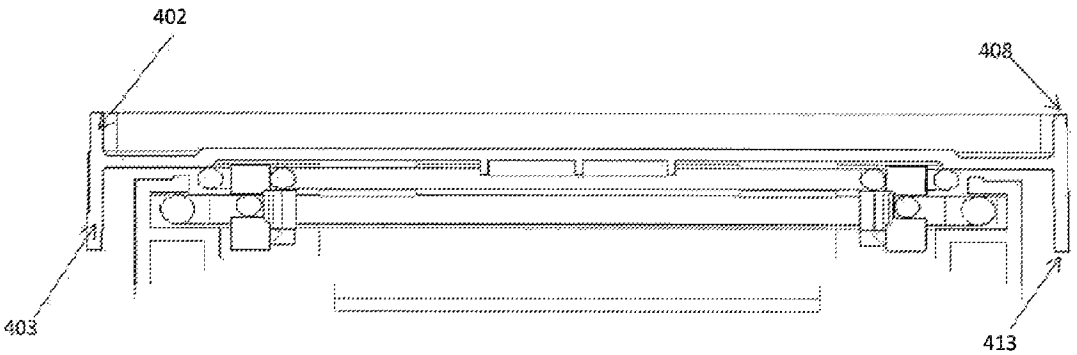
In FIG. 7*c* a cross cut view of the base of the drawer of the sliding system for drawer with the components which make up the system can be seen.
Figure 7B:
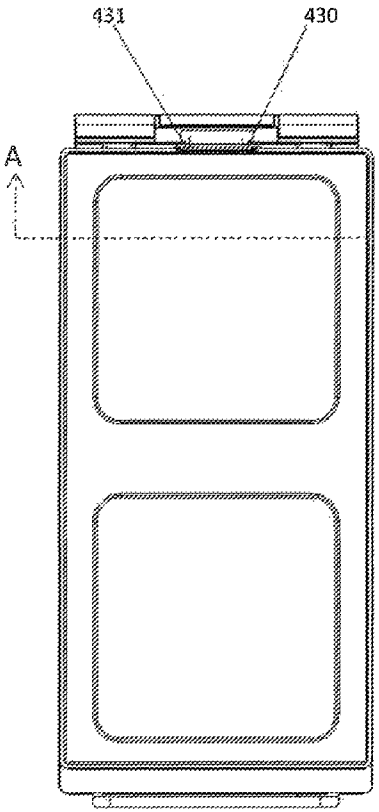
In FIG. 7*b* an upper view of the base of the drawer of the sliding system for drawer can be seen.
Figure 8:
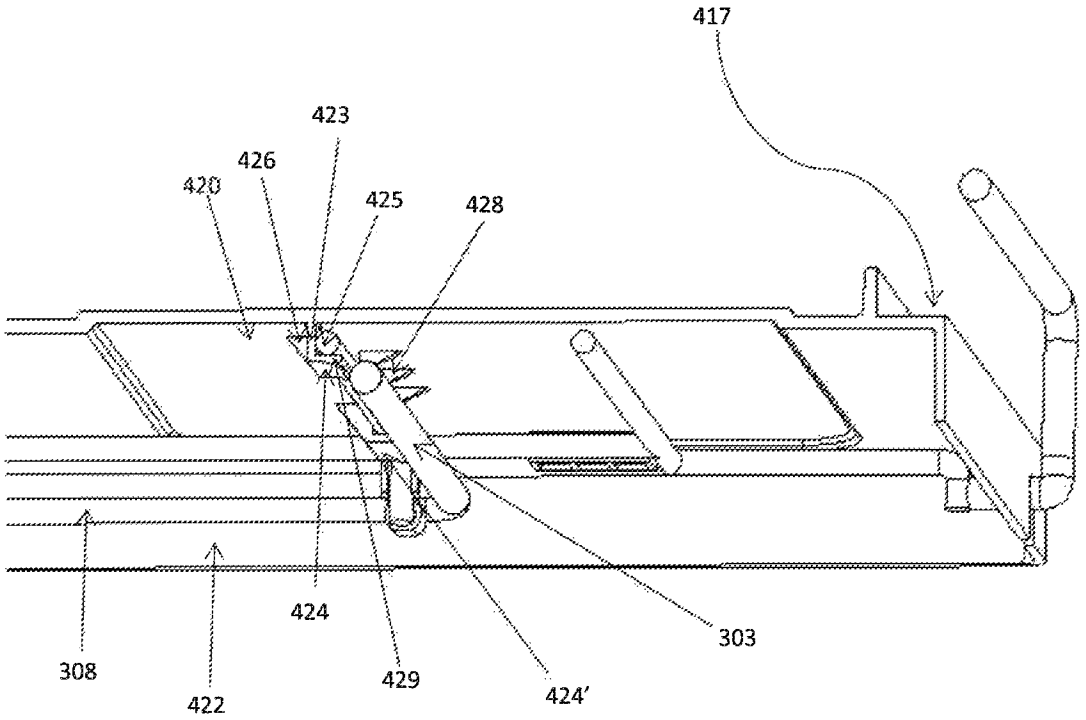
In FIG. 8 a cross cut view of the base of the drawer of the sliding system for drawer can be seen in detail.
Figure 9:
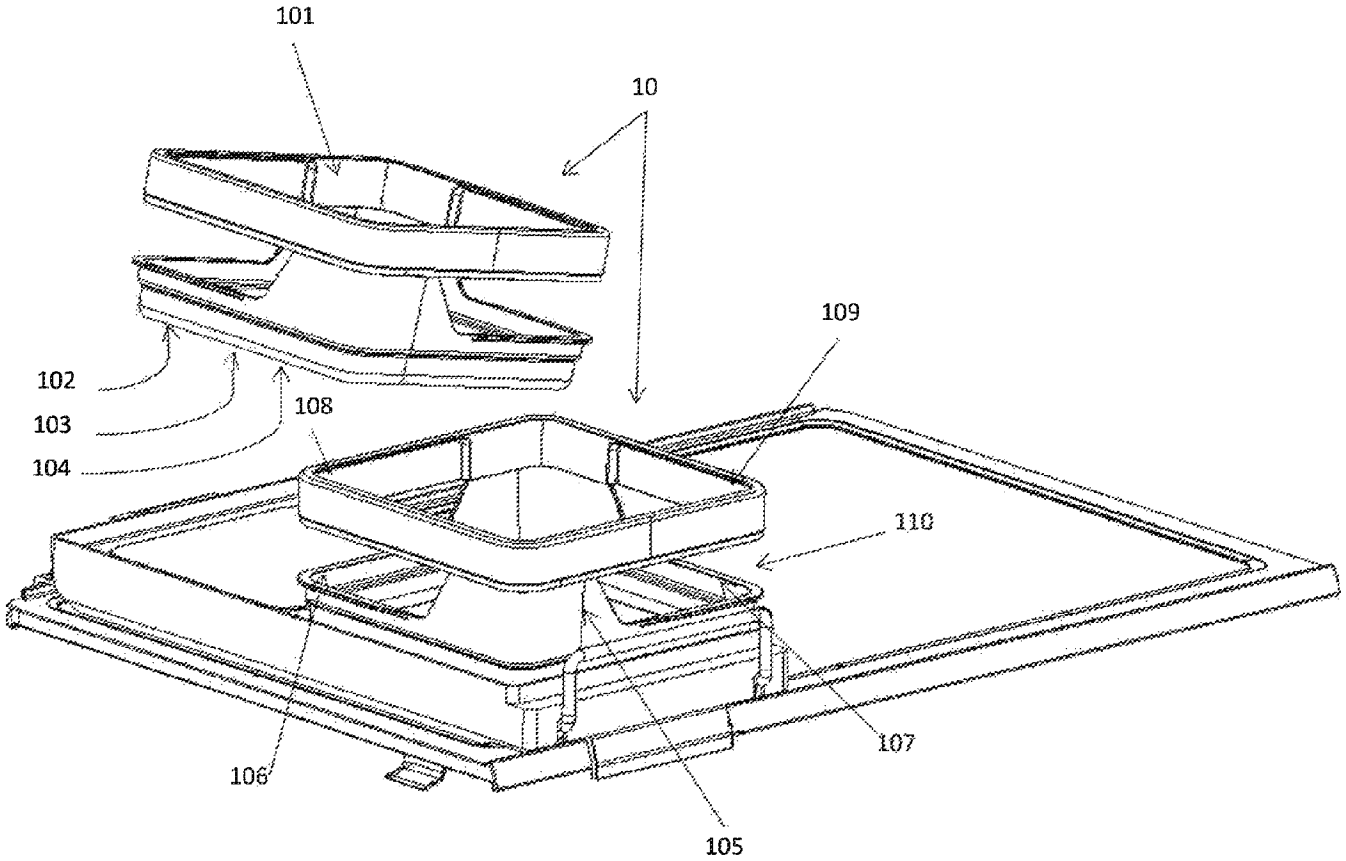
In FIG. 9 the drawers of the sliding system for drawer can be seen in detail.

The following description references FIGS. 1 through 9 in an indistinctive manner.

The present invention relates to a sliding system (100) for drawers (10) which comprises a main base (20) which is fixed unto a grill (1), whose front end (203) of the base (20) overlaps the same; a wire rod base (30) set over the main base (20) by means of a rail, said wire rod base (30) allows for the complete aperture of the drawer (10); a base (40) of the drawer, which supports the drawers (10) and remains fixed unto the system (100); a plurality of bushings (50) which decrease the amount of friction which allows for smooth and silent sliding; a magnet (60) which provides a closing force to the drawer (10) which grants the sensation of closing when the drawer reaches the bump; and extractable and transportable drawers (10).

The main base (20) comprises an upper surface (201) and a lower surface (202), a front end (203) and a back end (204).

The upper surface (201) presents two lateral walls (205, 206) and a back wall (207), said lateral walls (205, 206) present an upper end (208) which is doubled towards the center of the base (20), thereby forming, together with the upper surface (201) of the base, a rail (209) on the inner surface (210) of the same.

The front end (203) presents a first coupling (211) which extends towards the front and downwardly from said front end (203), the back end (204) presents a second coupling (212) which extends downwardly and inwardly from said back end (204) in such a way that said first (211) and second (212) couplings are coupled unto the front and back ends of the grill (1), making lateral displacement of the main base (20) over the grill (1) possible.

The upper surface (201) presents near the front end (203) a transversal flange (213) which is set perpendicularly to said upper surface (201); the back wall (207) presents a recess (214) where the magnet (60) is lodged.

The wire rod base (30) comprises a first frame (301) and a second frame (302), which are substantially rectangular, the first frame (301) being wider than the second frame (302).

Said first frame (301) comprises a front end (303), a back end (304) and two lateral ends (305, 306), similarly it presents a pair of longitudinal arms (307, 308) which are set towards the inner part of the frame, which are substantially parallel to the lateral ends (305, 306), said lateral ends (305, 306) are the ones which are coupled unto the inner part of the rail (209) which is set on the inner surface (210) of the lateral walls (205, 206) of the main base (20), the position of the transversal flange (213) determines the length of the runway of the first frame (301), given that the back end (304) of said first frame (301) comes into contact with said flange (213).

The second frame (302) comprises a first section (309), a transition zone (310) and a second section (311); likewise, it also comprises a front end (312), a back end (313) and two lateral ends (314, 315), the back end (313) being set over the first section (309) and the front end (312) over the second section (311), said second section (311) is substantially perpendicular to the first section (309), the first section (309) presents a pair of longitudinal arms (316) which are set towards the inner part of the second frame (302), which are substantially parallel to the lateral ends (314, 315), it also presents a plurality of transversal members (317), preferably three, set along the entire length of said longitudinal arms (316); said three transversal members comprise a first transversal end member (318), an intermediary transversal member (319) and a second transversal end member (320), the intermediary transversal member (319) being in close proximity to the second transversal end member (320); a plurality of coupling members (321), preferably four, set downwardly from said second frame (302), said coupling members (321) are found set at the joining points (322) between the longitudinal arms (316) and the back end (313) and the longitudinal arms (316) and the intermediary transversal member (319), said coupling members (321) present a first vertical section (322') which is set downwardly and a second horizontal section (323) which is set towards the lateral ends (314, 315) of said second frame (302), in such a way that they form a coupling space (324) which is substantially greater in size than the size of the wire rod which is used for the first frame (301).

The transition zone (310) which is set over the first (309) and the second (311) section comprises a first vertical change of direction (325) downwardly from the first section (326), a second change of direction (326) which is horizontal towards the front of the first change of direction and a third vertical change of direction (327) which is upwardly from the second change of direction, in such a way that the first (325) and the second change of direction (326) are perpendicular to each other, the second change (326) of direction and the third change of direction (327) are perpendicular to each other, and the first change of direction (325) and the third change of direction (327) are parallel to each other.

The length of the runway of the second frame (302) is found to be determined by the position of the transverse intermediary member (319), which is where the coupling members (321) are found which bump into the front end (303) of the first frame (301) of the wire rod base (30).

A plurality of bushings (50) which are found on the coupling members (321) of the second frame (302), which come into direct contact with the longitudinal arms (307, 308) of the first frame (301) to decrease the amount of friction and provide a smoothness sensation at the moment of opening/closing the system (100) in question. Said bushings (50) comprise circumferential segments set by pressure unto said coupling members (321).

The drawer base (40) comprises a coupling surface (401) which presents a plurality of upper walls (402) and a plurality of lower skirts (403).

The plurality of upper walls (402) comprises a front wall (404), a back wall (405) and two lateral walls (406, 407), both of which extend perpendicularly upwardly from said coupling surface (401) towards an upper point (408) above said coupling surface (401) forming a closed drawer.

The back wall (405) presents a housing (430) on its outer surface, wherein a metallic plate (431) is placed, which interacts with the magnet (60), which is set on the recess (214) of the back wall (207) of the main base (20).

The plurality of lower skirts (403) comprise a front skirt (410) and two lateral skirts (411, 412), both of which extend perpendicularly in a downwardly manner from said coupling surface (401) until a lower point (413) which is below said coupling surface (401), forming a protection at the front and on the sides of the area which is below the coupling surface (401); the front skirt (410) presents two vertical grooves (415, 416) which are symmetrical and in close proximity to the ends of said skirt (410) which extend from the lower point (413) until approximately the halfway point of the height of said skirt (410), through said grooves (415, 416) a second section (311) is found to be overlapping of the second frame (302) of the wire rod base (30).

The distance from the coupling surfaces (401) towards the lower point (413) is greater than the distance from the coupling surface (401) towards the upper point (408), so that the lower skirts (403) present a greater length than that of the upper walls (402).

The lower skirts (403), the upper lateral walls (406, 407) and the back upper wall (405) extend themselves from the periphery of the coupling surface (401), while the front upper wall (404) extends itself from the inner part of the front end of said coupling surface (401), in such a way that the lower lateral skirts (411, 412) are longer than the upper lateral walls (406, 407), thereby forming a space (417) between the upper front wall (404) and the second section (311) of the second frame (302) of the wire rod base (30) thereby allowing that the user is able to introduce his/her fingers into said space (417) and use the second section (311) of the second frame (302) of the wire rod base (30) as a drawer pull.

The coupling surface (401) presents at least one pair of protrusions (418, 419) over the upper surface, which are preferably quadrangular, in such a way that they form at least one pair of cavities (420, 421) on the lower surface of said coupling surface (401); within said cavities (420, 421) a plurality of fasteners (422) are found, which firmly fasten the transversal members (317) which are found at the first section (309) of the second frame (302) of the wire rod base (30).

Said fasteners (422) comprise a first transversal wall (423) which extends vertically in a downwardly manner until a lower point (424) and a second transversal wall (424') which extends horizontally towards the front from said lower point (424), thereby forming a cavity (425) where a transversal member (417) shall be lodged to the sides of said first transversal wall (423) which extends vertically in a downwardly direction, where a pair of bevels (426, 427) are found, one per each side, which extend towards the back of said first transversal wall (423), in order to grant it the sufficient rigidity to said wall; at the front of the cavity (425) which is formed, a plurality of longitudinal bevels (428) are placed, leaving a space (429) so that the transversal member (317) enters by pressure in order to avoid that the transversal member (317) which is set within the inner part of said cavity (425) be able to dislodge with ease.

The drawers (10) comprise an open upper end (101) as well as a closed lower end (102), said closed lower end (102) presents on its lower surface (103) a cavity (104) which coincides with the protrusion (418, 419) which is set on the coupling surface (401), in such a way that the drawer (10) is found coupled unto said coupling surface (401).

Said drawer (10) presents a peripheral wall (105) that is set between said open upper ends (101) and the lower closed end (102), said peripheral wall (105) presents a pair of cavities (106, 107) which are set on two corners (108, 109) which are diametrically opposed to each other, and which are found at the intermediary zone (110) of said wall (105).

Alterations to the structure hereby described for the present invention can be foreseen by those persons skilled in the art. However, it should be understood that present description is related with the preferred embodiments of the invention, which is merely for illustrative purposes and should not be construed as a limitation of the present invention. All amendments, which do not depart from the scope of the invention, such as changes to the shape, material and sizes of the different pieces, should be considered to lie within the scope of the attached claims.

The invention claimed is:

1. A system for sliding a drawer comprising:

a main base which is coupleable to a grill, the main base having a first end, a second end distant from the first end and lateral walls, each lateral wall forming a rail:

a wire rod base set over the rail in a slideable manner in relation to the main base;

a drawer base which supports the drawer and is fixed according to the system, the drawer base is set over the wire rod base;

at least two bushings set on the wire rod base; and a magnet set in near proximity of the second end of the main base housed within a recess of a wall Which is perpendicular to the general orientation of the main base.

2. The system according to claim 1, wherein the wire rod base comprises a first frame and a second frame, the first frame comprises longitudinal arms which are oriented towards the inner part of the first frame parallel to some lateral ends of the first frame and which are coupleable to the rail of the main base.

3. The system according to claim 2, wherein the system additionally comprises a transversal flange which is set perpendicularly to the general orientation of the main base in order to limit the length of the runway of the wire rod base.

4. The system according to claim 3, wherein one back end of said first frame comes into contact with the transversal flange set perpendicularly to the general orientation of the main base in order to determine a length of the runway for the first frame.

5. The system according to claim 3, wherein a second section of a first end of the second frame is substantially perpendicular to a first section of a second end of the second frame.

6. The system according to claim 5, wherein some longitudinal arms of the first section are set into the inner part of the second frame, said longitudinal arms are parallel to some lateral ends, and said longitudinal arms of the second frame are found longitudinally set with: a transversal end member, a transversal intermediary member and a second transversal end member, wherein the intermediary transversal end member is in close proximity to the second transversal end member.

7. The system according to claim 6, wherein the runway of the second frame is determined by the position of the intermediary transversal member, position at which some coupling members are found which bump into a front end of the first frame of the wire rod base.

8. The system according to claim 3, wherein a transition zone of the second frame which is found set between a first and second section comprises a first change of vertical direction which is downwardly from the first section, a second horizontal change of direction towards the front of the first change of direction and perpendicular to the first change of direction, and a third vertical change of direction which is upwards from the second change of direction and perpendicular to the second change of direction, the first and third change of directions are parallel and have the same change of direction.

9. The system according to claim 1, wherein the wire rod base comprises a plurality of coupling members, said coupling members are set to form a coupling space which is substantially greater than the size of the wire rod used in a first frame of the wire rod base, wherein the bushings are found set on the coupling members and come into direct contact with some longitudinal arms of a first frame of the wire rod base.

10. The system according to claim 1, wherein the drawer base comprises a coupling surface with a plurality of upper walls and a plurality of lower skirts, wherein the plurality of lower skirts has a greater length than the plurality of upper walls and the plurality of upper walls comprises peripheral walls which extend themselves perpendicularly upwardly from said coupling surface forming a closed drawer, wherein at least one wall of said peripheral walls has a housing within which a metallic plate is housed, wherein the plurality of lower skirts comprises a front skirt and two lateral skirts, which extend themselves perpendicularly downwardly from said coupling surface, the front skirt presents two symmetrical vertical grooves in close proximity to some ends of said front skirt, the symmetrical vertical grooves are extended until approximately half the height of said front skirt, a second section of a second frame of the wire rod base overlaps through said vertical symmetrical grooves.

11. The system according to claim 10, wherein the coupling surface has at least one pair of protrusions over an upper surface of the coupling surface forming at least one pair of cavities on a lower surface of said coupling surface, in said at least one pair of cavities a plurality of fasteners are found which firmly fasten some transversal members set on a first section of the second frame of the wire rod base, wherein said plurality of fasteners comprise a cavity wherein a transversal member will be housed and wherein a plurality of brackets are placed within the cavity leaving a space to place the transversal member.

12. The system according to claim 1, wherein the drawer base comprises a coupling surface with at least one pair of protrusions wherein the drawer comprises a closed lower end with a lower surface, the lower surface with a cavity which is coinciding with the at least one pair of protrusions set on the coupling surface, in such a way that the drawer is found coupled to said coupling surface, the drawer presents a peripheral wall with a pair of cavities.

13. The system according to claim 1, wherein the rail is formed on an inner surface of the main base, the rail has ends which are perpendicular to the lateral walls which are doubled towards the inside according to the main base which is coupled to the main base with the grill.

14. A piece of furniture comprising the system of claim 1.

* * * * *